US005469343A

United States Patent [19]

Speck

[11] Patent Number: 5,469,343

[45] Date of Patent: Nov. 21, 1995

[54] WALKING IMPLEMENT WITH ASSOCIATED LIGHTING DEVICE

[76] Inventor: Glen J. Speck, 2230 S. K St., Oxnard, Calif. 93033-4346

[21] Appl. No.: 314,098

[22] Filed: Sep. 28, 1994

[51] Int. Cl.[6] ..... A45B 3/021

[52] U.S. Cl. ..... 362/102; 362/376; 135/910

[58] Field of Search ..... 362/102, 190, 362/191, 396; 135/65, 66, 909, 910

[56] References Cited

U.S. PATENT DOCUMENTS

| | | | |
|---|---|---|---|
| 2,811,978 | 11/1957 | Russell | 135/65 |
| 2,948,076 | 8/1960 | Patricello | 362/191 |
| 4,837,666 | 6/1989 | Conkle | 135/65 |
| 5,349,438 | 9/1994 | Lerner | 362/363 |

FOREIGN PATENT DOCUMENTS

| | | | |
|---|---|---|---|
| 889682 | 9/1953 | Denmark | 362/102 |
| 63089 | 8/1968 | France | 362/396 |
| 867661 | 8/1941 | Germany | 362/102 |

*Primary Examiner*—Ira S. Lazarus
*Assistant Examiner*—Y. Quach

[57] ABSTRACT

It is an object of the present invention to provide a new and improved walking device with an associated light assembly. The walking implement has a first end, a second end and an intermediate extent therebetween. A cylindrical light assembly housing is included which has an upper extent, a lower extent, an outer surface, an inner surface, a closed rearward end, an open forward end. A male thread element extends about the open forward end of the assembly. An aperture is formed through the upper extent of the light assembly. A cylindrical lens cap is included which has a forward end and a rearward end. A circular transparent lens is positioned within the forward end of the cylindrical lens cap. A female thread element extends about the rearward end of the cylindrical lens cap. The female thread element is adapted to be engaged with the male thread element of the cylindrical light assembly housing. A reflective element is positioned within the cylindrical light assembly, and an aperture is formed within the reflective element. The reflective element is positioned and adapted to reflect light towards the forward end of the light assembly housing. A light, which is positioned within the aperture of the reflective element, is both positioned and adapted to direct light towards the forward end of the light assembly housing. Furthermore, a power source is positioned within the light assembly housing. The power source being electrically coupled to the light. A switch is positioned within the aperture of the light assembly housing, the switch being operatively connected to the power source. The switch functions to selectively deliver power to the light. A first means is included to secure the light assembly housing to the intermediate extent of the walking implement. Likewise, a second means is included to secure the light assembly housing to the intermediate extent of the walking implement.

2 Claims, 4 Drawing Sheets

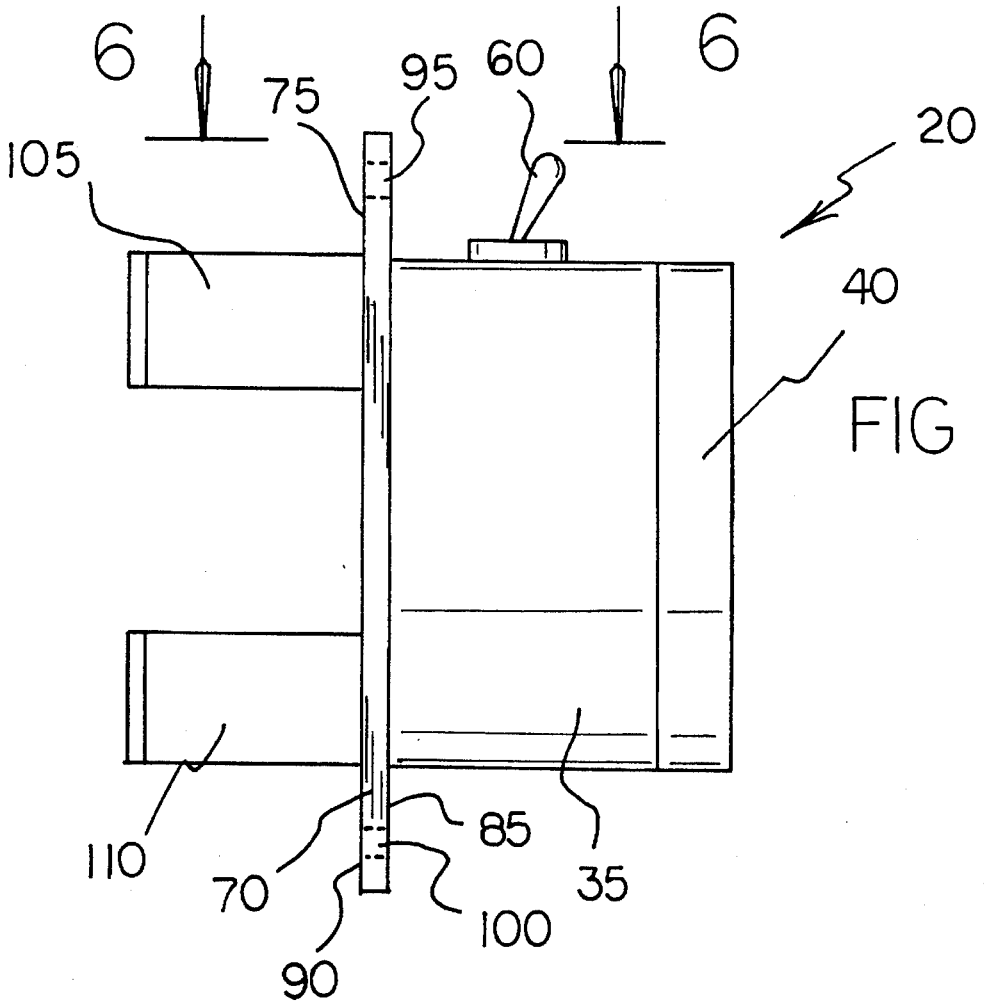
FIG 5
FIG 6
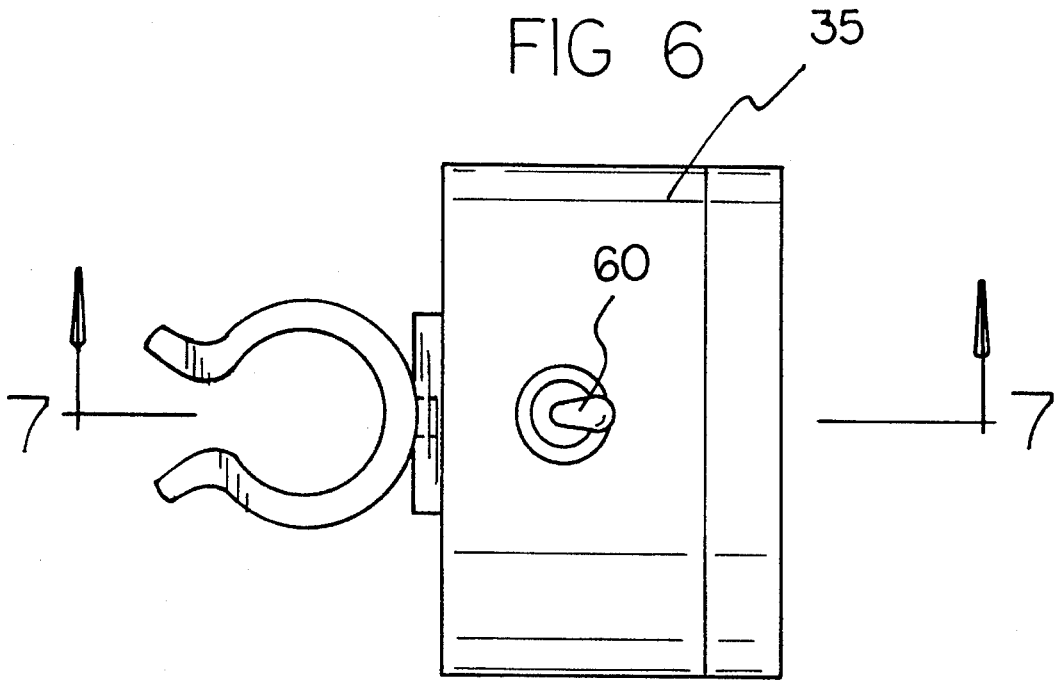

WALKING IMPLEMENT WITH ASSOCIATED LIGHTING DEVICE

BACKGROUND OF THE INVENTION

1. Field of the Invention

The present invention relates to a walking implement with associated lighting device and more particularly pertains to attaching a lighting device to a walking implement.

2. Description of the Prior Art

The use of lighting devices is known in the prior art. More specifically, lighting devices heretofore devised and utilized for the purpose of lighting a path are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,099,535 to Hubachek discloses a light emitting walking cane.

U.S. Pat. No. 4,562,850 to Earley et al. discloses a combination walking cane, path light and uprisal device.

U.S. Pat. No. 5,197,501 to Ragatz discloses a multipurpose cane.

U.S. Pat. No. 4,062,371 to Bolen discloses a walking cane for use by the blind.

Lastly, U.S. Pat. No. 4,625,742 to Phillips discloses a multi-function lighted walking cane.

In this respect, the walking implement with associated lighting device according to the present invention substantially departs from the conventional concepts and designs of the prior art, and in doing so provides an apparatus primarily developed for the purpose of attaching a lighting device to a walking implement.

Therefore, it can be appreciated that there exists a continuing need for a new and improved walking implement with associated lighting device which can be used for attaching a lighting device to a walking implement. In this regard, the present invention substantially fulfills this need.

SUMMARY OF THE INVENTION

In view of the foregoing disadvantages inherent in the known types of lighting devices now present in the prior art, the present invention provides an improved walking implement with associated lighting device. As such, the general purpose of the present invention, which will be described subsequently in greater detail, is to provide a new and improved walking implement with associated lighting device and method which has all the advantages of the prior art and none of the disadvantages.

To attain this, the present invention essentially comprises a walking implement and an associated light assembly. In its broadest context, the present invention includes a walking implement such as a walker, cane, crutch or the like, a light assembly, and various coupling means for securing the light assembly to the walking implement. More specifically, the invention includes a walking implement having a first end, a second end and an intermediate extent therebetween. The light assembly includes a light assembly housing, a lens cap, a reflective element, a light, a power source and a switch. The cylindrical light assembly housing has an upper extent, a lower extent, an outer surface, an inner surface, a closed rearward end, and an open forward end. A male thread element extends about the open forward end of the housing. Furthermore, an aperture is formed through the upper extent of the light assembly. The cylindrical lens cap has a forward end and a rearward end. A circular transparent lens is positioned within the forward end of the cylindrical lens cap. A female thread element extends about the rearward end of the cylindrical lens cap. The female thread element is adapted to be engaged with the male thread element of the cylindrical light assembly housing. Thus, the lens cap is rotatably fitted onto the light assembly housing. The reflective element, which is positioned within the cylindrical light assembly housing, includes an aperture formed therein. The reflective element is positioned and adapted to reflect light towards the forward end of the light assembly housing. The light is positioned within the aperture of the reflective element. As with the reflective element, the light is positioned and adapted to direct light towards the forward end of the light assembly housing. The power source for the light assembly is positioned within the light assembly housing. The power source is electrically coupled to the light in a conventional manner. The switch is positioned within the aperture of the light assembly housing. The switch is operatively connected to the power source in a conventional manner. The switch functions to selectively deliver power to the light. There are two means for mounting the light assembly to the walking implement, the mounting plate and the clips. The operator of the device can use either of the means to couple the light assembly to the implement. Furthermore, both means can be used to couple the light assembly to the implement. The mounting plate has an upper extent, a lower extent, a first side and a second side. The first side of the plate is secured to the closed rearward end of the light assembly housing. An upper aperture is formed within the upper extent of the mounting plate, and a lower aperture is formed within the lower extent of the mounting plate. The upper and lower apertures, together function as a means to secure the light assembly housing to the intermediate extent of the walking implement. The clips include both an upper and a lower clip. The upper clip is coupled to the upper extent of the light assembly housing, and the lower clip is coupled to the lower extent of the light assembly housing. The upper clip has a closed first end and an open second end. The closed first end is secured to the upper extent and second side of the mounting plate. The open second end of the clip is adapted to receive the intermediate extent of the walking implement. The lower clip has a closed first end and an open second end. The closed first end is secured to the lower extent and second side of the mounting plate. The open second end of the clip is adapted to receive the intermediate extent of the walking implement. The upper and lower clips, together function as a means to secure to light assembly housing to the walking implement.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walking implement with associated lighting device which has all the advantages of the prior art lighting devices and none of the disadvantages.

It is another object of the present invention to provide a new and improved walking implement with associated lighting device which may be easily and efficiently manufactured and marketed.

It is further object of the present invention to provide a new and improved walking implement with associated lighting device which is of durable and reliable constructions.

An even further object of the present invention is to provide a new and improved walking implement with associated lighting device which is susceptible of a low cost of manufacture with regard to both materials and labor, and which accordingly is then susceptible of low prices of sale to the consuming public, thereby making such walking implement with associated lighting device economically available to the buying public.

Still yet another object of the present invention is to provide a new and improved walking implement with associated lighting device which provides in the apparatuses and methods of the prior art some of the advantages thereof, while simultaneously overcoming some of the disadvantages normally associated therewith.

Even still another object of the present invention is to attach a lighting device to a walking implement.

Lastly, it is an object of the present invention to provide a new and improved walking device with an associated light assembly. The walking implement has a first end, a second end and an intermediate extent therebetween. A cylindrical light assembly housing is included which has an upper extent, a lower extent, an outer surface, an inner surface, a closed rearward end, an open forward end. A male thread element extends about the open forward end of the assembly. An aperture is formed through the upper extent of the light assembly. A cylindrical lens cap is included which has a forward end and a rearward end. A circular transparent lens is positioned within the forward end of the cylindrical lens cap. A female thread element extends about the rearward end of the cylindrical lens cap. The female thread element is adapted to be engaged with the male thread element of the cylindrical light assembly housing. A reflective element is positioned within the cylindrical light assembly, and an aperture is formed within the reflective element. The reflective element is positioned and adapted to reflect light towards the forward end of the light assembly housing. A light, which is positioned within the aperture of the reflective element, is both positioned and adapted to direct light towards the forward end of the light assembly housing. Furthermore, a power source is positioned within the light assembly housing. The power source being electrically coupled to the light. A switch is positioned within the aperture of the light assembly housing, the switch being operatively connected to the power source. The switch functions to selectively deliver power to the light. A first means is included to secure the light assembly housing to the intermediate extent of the walking implement. Likewise, a second means is included to secure the light assembly housing to the intermediate extent of the walking implement.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side elevational of the lighting device in accordance with the present invention.

FIG. 6 is a view taken along line 6—6 of FIG. 5.

The same reference numerals refer to the same parts through the various Figures.

DESCRIPTION OF THE PREFERRED EMBODIMENT

Figure 1:
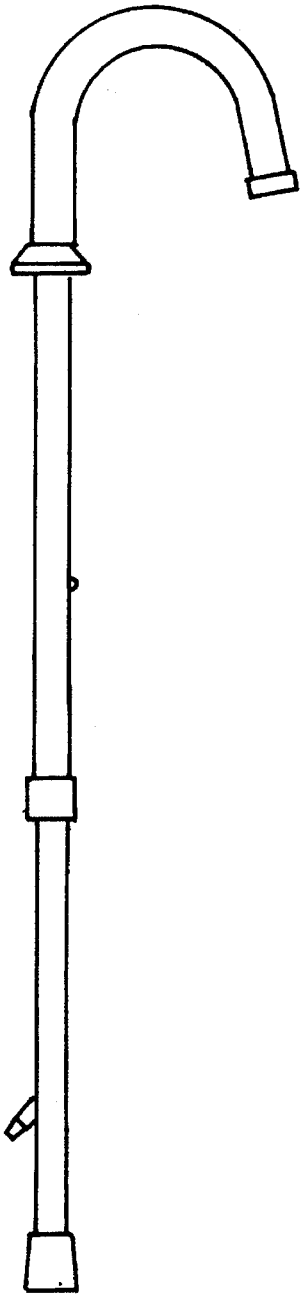
FIG 1 PRIOR ART
FIG. 1 is a view of a prior art combination walking cane and path light.
Figure 2:
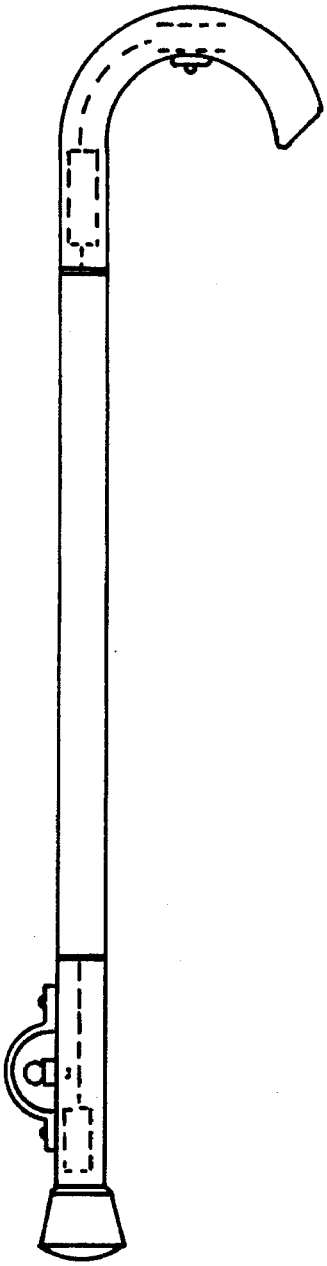
FIG 2 PRIOR ART
FIG. 2 is a view of a prior art walking cane for use by the blind.
Figure 3:
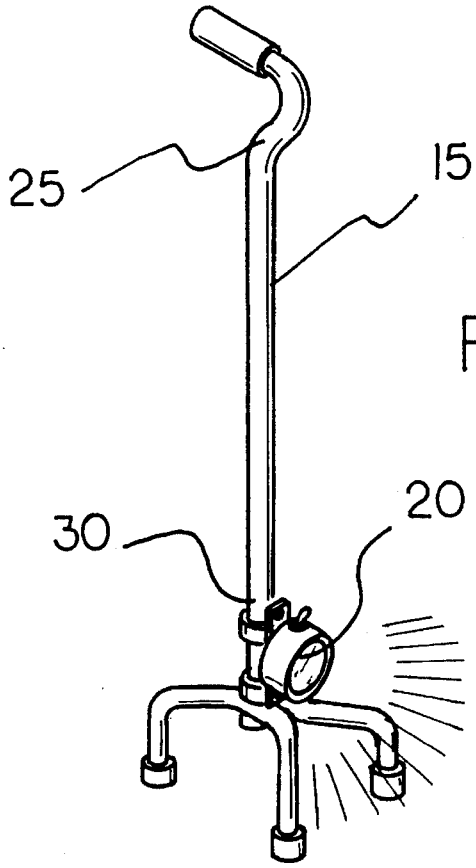
FIG. 3 is a perspective view of the present invention.
Figure 4:
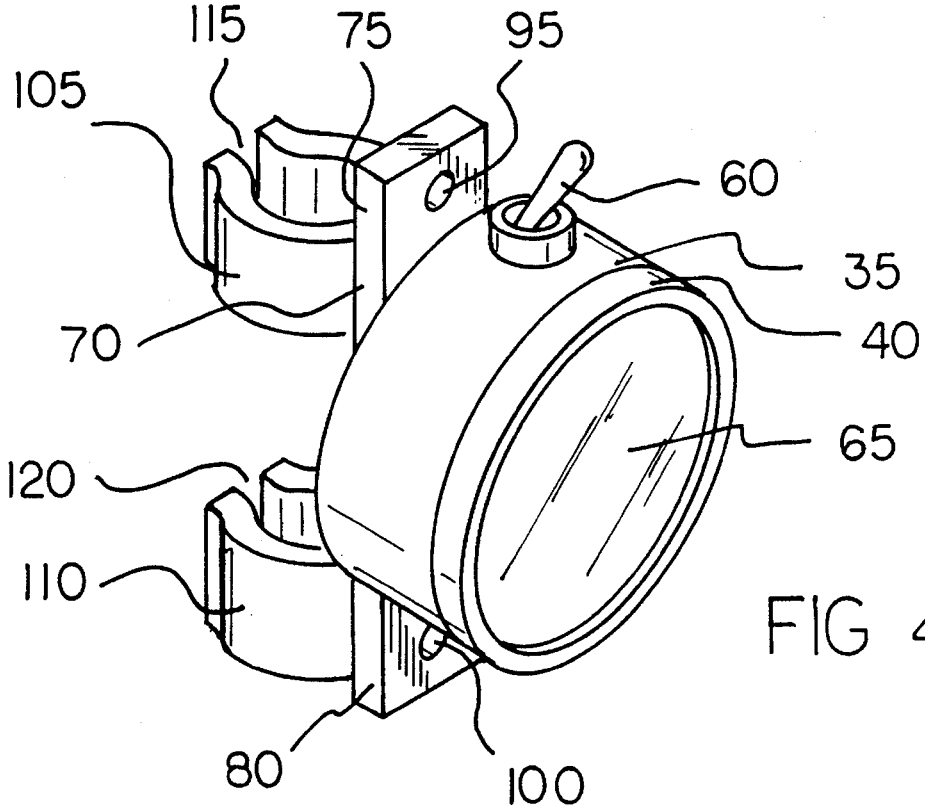
FIG. 4 is a view of the lighting device in accordance with the present invention.
Figure 7:
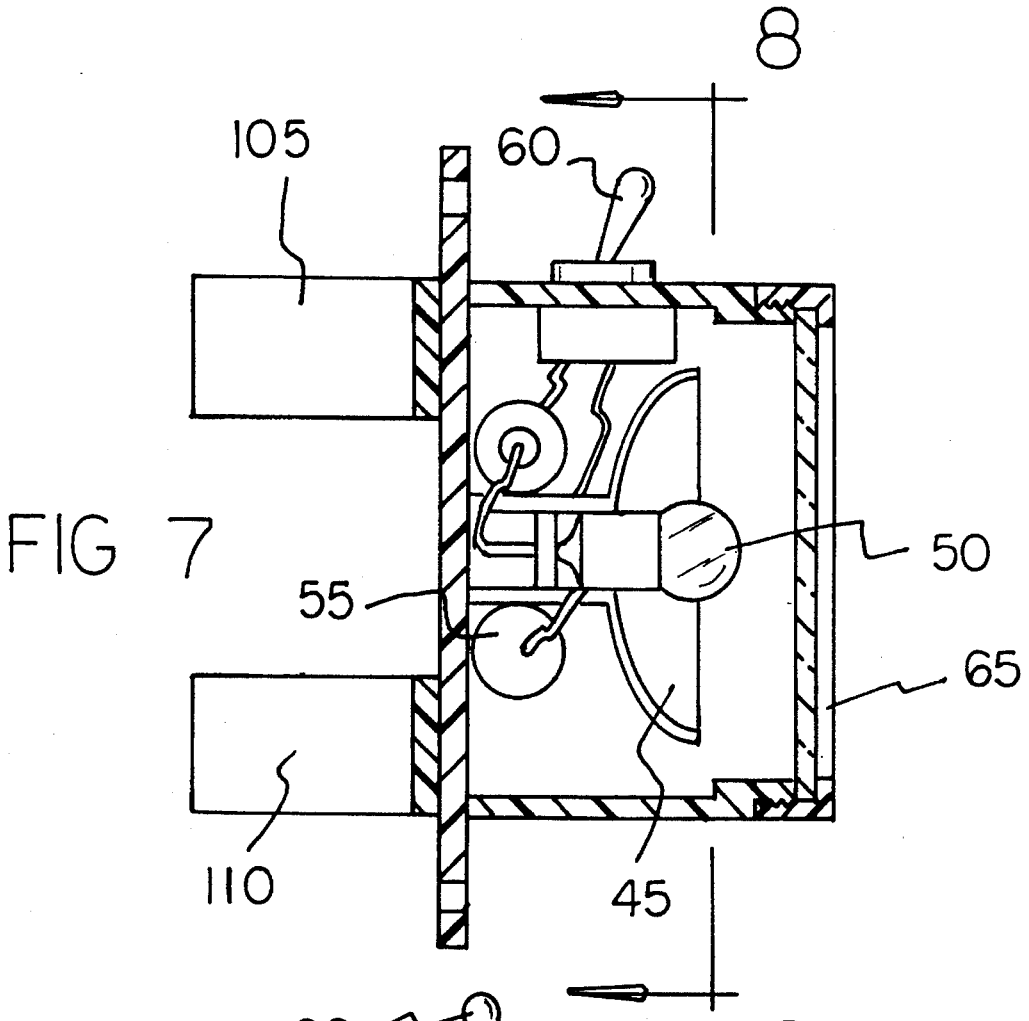
FIG. 7 is a view taken along line 7—7 of FIG. 6.
Figure 8:
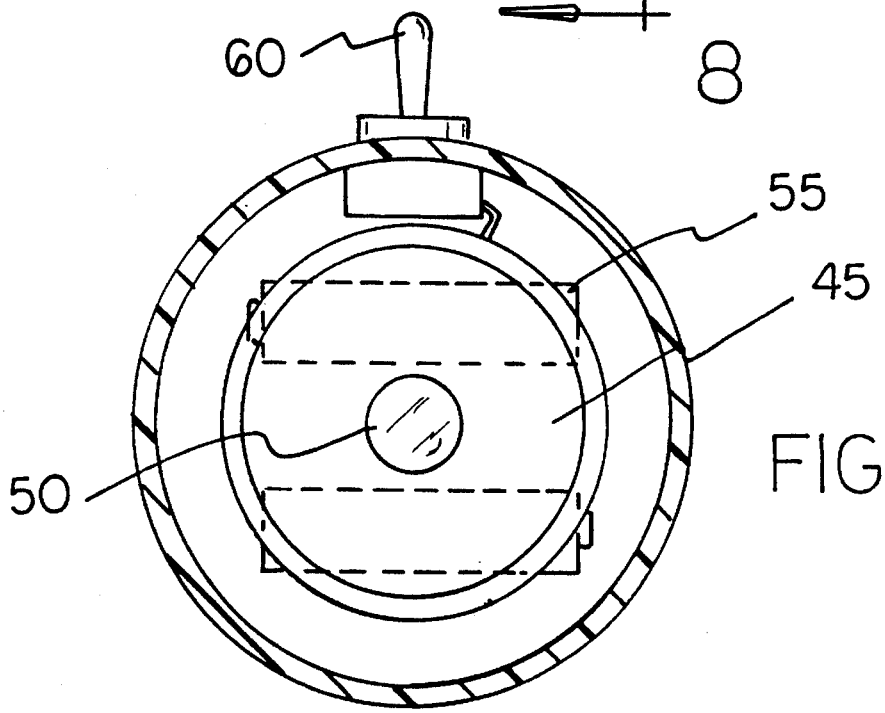
FIG. 8 is a view taken along line 8—8 of FIG. 7.

With reference now to the drawings, and in particular to FIG. 1 thereof, the preferred embodiment of the new and improved walking implement with associated lighting device embodying the principles and concepts of the present invention and generally designated by the reference numeral 10 will be described.

The present invention relates to a walking implement 15 and an associated light assembly 20. In its broadest context, the present invention includes a walking implement 15 such as a walker, cane, crutch or the like, a light assembly 20, and various coupling means for securing the light assembly to the walking implement.

More specifically, the invention includes a walking implement 15 having a first end 25, a second end 30 and an intermediate extent therebetween. The light assembly 20 includes a light assembly housing 35, a lens cap 40, a reflective element 45, a light 50, a power source 55 and a switch 60. The cylindrical light assembly housing 35 has an upper extent, a lower extent, an outer surface, an inner surface, a closed rearward end, and an open forward end. A male thread element extends about the open forward end of the housing. Furthermore, an aperture is formed through the upper extent of the light assembly. The cylindrical lens cap 40 has a forward end and a rearward end. A circular transparent lens 65 is positioned within the forward end of the cylindrical lens cap 40. A female thread element extends about the rearward end of the cylindrical lens cap 40. The female thread element is adapted to be engaged with the male thread element of the cylindrical light assembly housing 20. Thus, the lens cap 40 is rotatably fitted onto the light assembly housing 20. The reflective element 45, which is positioned within the cylindrical light assembly housing 20, includes an aperture formed therein. The reflective element is positioned and adapted to reflect light towards the forward end of the light assembly housing 20. The light is positioned within the aperture of the reflective element. As with the reflective element 45, the light 50 is positioned and adapted to direct light towards the forward end of the light assembly housing 20. The power source 55 for the light assembly is positioned within the light assembly housing 20. The power source is electrically coupled to the light in a conventional manner. The switch 60 is positioned within the aperture of the light assembly housing 20. The switch 60 is operatively connected to the power source 55 in a conventional manner. The switch 60 functions to selectively deliver power to the light 50.

There are two means for mounting the light assembly to the walking implement, the mounting plate 70 and the clips. The operator of the device can use either of the means to couple the light assembly to the implement. Furthermore, both means can be used to couple the light assembly 20 to the implement 15.

To ensure a positive coupling between the walking implement and the light assembly both means should be employed. Namely, the clips are secured about the walking implement and screws are inserted through the apertures and into the walking implement.

The mounting plate 70 has an upper extent 75, a lower extent 80, a first side 85 and a second side 90. The first side 85 of the plate 70 is secured to the closed rearward end of the light assembly housing 20. An upper aperture 95 is formed within the upper extent 75 of the mounting plate 70, and a lower aperture 100 is formed within the lower extent 80 of the mounting plate 70. The upper and lower apertures 95, 100 together function as a means to secure the light assembly housing 20 to the intermediate extent of the walking implement 15.

The clips include both an upper 105 and a lower clip 110. The upper clip 105 is coupled to the upper extent of the light assembly housing 20, and the lower clip 110 is coupled to the lower extent of the light assembly housing 20. The upper clip 105 has a closed first end and an open second end 115. The closed first end is secured to the upper extent 75 and second side of the mounting plate 70. The open second end 75 of the clip is adapted to receive the intermediate extent of the walking implement 15. The lower clip 100 has a closed first end and an open second end 120. The closed first end is secured to the lower extent 80 and second side of the mounting plate 70. The open second end 120 of the clip 100 is adapted to receive the intermediate extent of the walking implement 15. The upper and lower clips 95, 100 together function as a means to secure to light assembly housing 20 to the walking implement 15.

Thus, the present invention as described is a small battery-operated light that attaches to a walker, crutches, a cane, a wheelchair, etc. It provides hands-free light in low light and no-light circumstances. The product consists of a few simple components. There is a small light bulb with a reflector. The bulb and reflector are mounted together in a plastic housing. The base of the housing features two screw holes for attaching the device to the desired object. Also, on the bottom of the housing are two clips in case the user prefers to attach the device by clipping it. In addition to the bulb and reflector, inside the housing is a compartment for two AA batteries, as well as the necessary wiring and brackets for this type of device. On the exterior of the product is an on/off switch. This invention could be made in varying sizes and shapes to accommodate different applications. Attach the product of the desired object by one of the three methods: clipping, screwing, or gluing. It is positioned so that users can see clearly in front of them. For example, with a walker, the products could be attached down near the legs of the walker so that the user will not trip on things lying on the floor. Simply flip the switch to activate the unit, and turn it to the "off" position when finished. This product is valuable not only because it increases visibility, but also because it enables others to see the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A walking device with an associated light assembly comprising;

a walking implement having a first end, a second end and an intermediate extent therebetween;

a cylindrical light assembly housing having an upper extent, a lower extent, an outer surface, an inner surface, a closed rearward end, an open forward end, a male thread element extending about the open forward end, an aperture formed through the upper extent of the light assembly housing;

a cylindrical lens cap having a forward end and a rearward end, a circular transparent lens positioned within the forward end of the cylindrical lens cap, a female thread element extending about the rearward end of the cylindrical lens cap, the female thread element adapted to be engaged with the male thread element of the cylindrical light assembly housing;

a reflective element positioned within the cylindrical light assembly housing, an aperture formed within the reflective element, the reflective element positioned and adapted to reflect light towards the forward end of the light assembly housing;

a light positioned within the aperture of the reflective element, the light positioned and adapted to direct light towards the forward end of the light assembly housing;

a power source positioned within the light assembly housing, the power source being electrically coupled to the light;

a switch positioned within the aperture of the light assembly housing, the switch being operatively connected to the power source, the switch functioning to selectively deliver power to the light;

a mounting plate having an upper extent, a lower extent, a first side and a second side, the first side of the plate being secured to the closed rearward end of the light assembly housing, an upper aperture formed within the upper extent of the mounting plate, a lower aperture formed within the lower extent of the mounting plate, a first screw inserted through the upper aperture and into the walking implement, a second screw inserted through the lower aperture and into the walking implement, the screws and apertures together functioning as a means to positively secure the mounting plate to the walking implement;

an upper clip having a closed first end and an open second end, the closed first end of the upper clip being secured to the upper extent and second side of the mounting plate, the open second end of the upper clip positioned over and received the intermediate extent of the walking implement; and a lower clip having a closed first end and an open second end, the closed first end of the lower clip being secured to the lower extent and second side of the mounting plate, the open second end of the lower clip positioned over and received the intermediate extent of the walking implement, the upper and lower clip together functioning as a means to secure to light assembly housing to the walking implement.

2. A walking device with an associated light assembly comprising;

a walking implement having a first end, a second end and an intermediate extent therebetween;

a cylindrical light assembly housing having an upper extent, a lower extent, an outer surface, an inner surface, a closed rearward end, an open forward end, a male thread element extending about the open forward end, an aperture formed through the upper extent of the light assembly housing;

a cylindrical lens cap having a forward end and a rearward end, a circular transparent lens positioned within the forward end of the cylindrical lens cap, a female thread element extending about the rearward end of the cylindrical lens cap, the female thread element adapted to be engaged with the male thread element of the cylindrical light assembly housing;

a reflective element positioned within the cylindrical light assembly housing, an aperture formed within the reflective element, the reflective element positioned and adapted to reflect light towards the forward end of the light assembly housing;

a light positioned within the aperture of the reflective element, the light positioned and adapted to direct light towards the forward end of the light assembly housing;

a power source positioned within the light assembly housing, the power source being electrically coupled to the light;

a switch positioned within the aperture of the light assembly housing, the switch being operatively connected to the power source, the switch functioning to selectively deliver power to the light;

a first means to secure the light assembly housing to the intermediate extent of the walking implement, the first means for securing the light assembly housing to the intermediate extent of the walking implement being a mounting plate having an upper extent, a lower extent, a first side and a second side, the first side of the plate being secured to the closed rearward end of the light assembly housing, an upper aperture formed within the upper extent of the mounting plate, a lower aperture formed within the lower extent of the mounting plate, a first screw positioned within the upper aperture and into the walking implement, a second screw positioned within the lower aperture and into the walking implement; and a second additional means to secure the light assembly housing to the intermediate extent of the walking implement, the second means being an upper clip having a closed first end and an open second end, the closed first end being coupled to the upper extent of the light assembly housing, the open second end of the upper clip adapted to receive the intermediate extent of the walking implement, a lower clip having a closed first end and an open second end, the closed first end of the lower clip being coupled to the lower extent of the light assembly housing, the open second end of the lower clip adapted to receive the intermediate extent of the walking implement, the upper and lower clip together functioning as a means to secure the light assembly housing to the walking implement.

* * * * *